US008360746B2

(12) United States Patent
White et al.

(10) Patent No.: US 8,360,746 B2
(45) Date of Patent: Jan. 29, 2013

(54) INVERTED PRESSURE REGULATING VALVE FOR AN ENGINE OIL PUMP

(75) Inventors: Stephen L. White, Kings Mountain, NC (US); Barry C. Titus, Chelsea, MI (US)

(73) Assignee: Metaldyne Company, LLC, Plymouth, MI (US)

( * ) Notice: Subject to any disclaimer, the term of this patent is extended or adjusted under 35 U.S.C. 154(b) by 935 days.

(21) Appl. No.: 11/801,608

(22) Filed: May 10, 2007

(65) Prior Publication Data

US 2008/0025851 A1 Jan. 31, 2008

Related U.S. Application Data

(60) Provisional application No. 60/799,192, filed on May 10, 2006.

(51) Int. Cl.
*F04B 49/00* (2006.01)

(52) U.S. Cl. ..... 417/307; 417/308; 417/309; 417/310; 417/311

(58) Field of Classification Search ..... 417/307, 417/310, 311, 440, 441, 308, 309
See application file for complete search history.

(56) References Cited

U.S. PATENT DOCUMENTS

| | | | | |
|---|---|---|---|---|
| 1,844,668 | A | 2/1932 | McGregor | |
| 1,935,544 | A | 11/1933 | De Lancey | |
| 3,270,675 | A | 9/1966 | Ajam | |
| 3,942,503 | A | 3/1976 | Hanaoka et al. | |
| 4,122,818 | A | 10/1978 | Hattori | |
| 4,971,528 | A * | 11/1990 | Hodgkins et al. | 417/310 |
| 5,169,294 | A * | 12/1992 | Barito | 417/310 |
| 5,277,028 | A * | 1/1994 | Worner et al. | 60/468 |
| 5,722,815 | A | 3/1998 | Cozens | |
| 5,759,013 | A * | 6/1998 | Miyazaki et al. | 417/310 |
| 6,086,337 | A * | 7/2000 | Watanabe et al. | 417/310 |
| 6,116,859 | A * | 9/2000 | Bodzak et al. | 417/310 |
| 6,352,085 | B1 | 3/2002 | Morita et al. | |
| 6,481,458 | B2 | 11/2002 | Hirano et al. | |
| 6,544,021 | B2 | 4/2003 | Wantanabe et al. | |
| 6,685,441 | B2 * | 2/2004 | Nam | 417/292 |
| 6,709,245 | B2 | 3/2004 | Bachmann | |
| 6,905,317 | B2 | 6/2005 | Hirabayashi et al. | |
| 2005/0098385 | A1 * | 5/2005 | Ono et al. | 184/6.5 |

* cited by examiner

*Primary Examiner* — Devon Kramer
*Assistant Examiner* — Christopher Maxey
(74) *Attorney, Agent, or Firm* — McDonald Hopkins LLC

(57) ABSTRACT

The present invention provides a valve assembly for relieving fluid pressure having a pump housing with a low pressure inlet chamber and a high pressure discharge chamber, a relief aperture positioned between the low pressure inlet chamber and the high pressure discharge chamber, a valve seat along the perimeter of the relief aperture, and a valve body located in the high pressure discharge chamber. The valve body has a first end capable of engaging the valve seat in a closed position and is also capable of axial travel opposite the fluid discharge at a predetermined pressure.

10 Claims, 5 Drawing Sheets

INVERTED PRESSURE REGULATING VALVE FOR AN ENGINE OIL PUMP

CROSS-REFERENCE TO RELATED APPLICATIONS

This application claims priority from U.S. Provisional Patent Application No. 60/799,192, entitled "Inverted Pressure Regulating Valve for an Engine Oil Pump" filed on May 10, 2006, which is hereby incorporated by reference herein.

FIELD OF THE INVENTION

This invention relates generally to fluid pumps, and more particularly, to an inverted pressure-regulating valve for an engine oil pump.

BACKGROUND OF THE INVENTION

There are numerous uses for fluid pumps across a wide range of industries. The automotive industry is one such industry that requires fluid pumps. In particular, a combustion engine vehicle includes an engine lubrication system designed to deliver clean oil at the correct temperature and pressure to the engine. The heart of the system is the oil pump, which pumps oil from the oil reservoir through a simple wire screen to strain out debris and then feeds the oil through a filter to further clean the oil. The oil is then pumped to different parts of the engine to assist in cooling and lubrication and then falls to the bottom of the engine crankcase, or oil reservoir, to continue the process.

One particular type of oil pump mechanism typically used in a vehicle engine is the gerotor pump. Gerotor pumps are positive displacement pumps using nested hypocycloid gear elements as their pumping elements. The inner rotor, called a pinion gear, meshes with and is located inside of the outer rotor, called a ring gear. These elements are supported on a pump housing for rotation about parallel, laterally separated centerlines. In a gerotor pump, the motor drives either the inner or the outer element, that element then driving the other element. These gear elements rotate relative to each other so as to create a pumping action.

Since the outer gear element has one tooth more than the inner gear element and both elements are mounted on fixed centers eccentric to each other, a one-tooth volume is opened and closed across each rotation. As the toothed elements turn, the chamber between the teeth of the inner and outer gear elements gradually increases in size through approximately 180° of each revolution until it reaches its maximum size, which is equivalent to the full volume of the "missing tooth". During this initial half of the cycle, the gradually enlarging chamber is exposed to the low pressure inlet port of the pump housing, creating a partial vacuum into which the oil flows. During the subsequent 180° of the revolution, the chamber gradually decreases in size as the teeth mesh and the liquid is forced out through the high pressure discharge port of the pump housing. Therefore, 360° rotation of the pumping elements creates a pumping action.

Oil pumps are designed to deliver oil in greater quantities and pressures than the engine actually requires. For example, when the inner gear element drives the gerotor pump, that inner drive element is coupled to the driveshaft so that the oil pump runs continuously while the engine is running. The gerotor will deliver a known, predetermined quantity of fluid in proportion to the speed of the input power. Such a continuously running oil pump provides consistently greater quantities of oil and oil pressure to the engine than are actually required. Constant oil pressure is maintained, and the additional oil pressure not required is vented off.

Automotive engine oil pumps typically employ a pressure relief valve to prevent overpressure. Typically, pressure relief valves are located on the low pressure inlet side. The front end of a valve body engages a valve seat, also on the low pressure side, along the perimeter of a relief aperture. Such configurations generally result in a cavity or depression on the high pressure side. Accordingly, when the pressure must be relieved, the fluid pressure acts on the front end of the valve body so that the valve body travels downward in the direction of the vented fluid flow to relieve the pressure to the low pressure inlet side.

During operation of the pump, however, debris may settle in the depression on the high pressure side. Therefore, as pressure is relieved, the debris flows through the gap generated between the front end and the valve seat and along the valve body toward the valve housing. As the pressure decreases, the front end reengages the valve seat to close the relief aperture. At any point in this operation, debris may become trapped between the valve seat and the front end and/or the sliding valve body and the valve housing, resulting in relief valve failure. As relief valve assemblies are manufactured with close tolerances, only a small amount of debris may result in relief valve failure. Further, it is difficult to prevent the introduction of debris, such as bits of wire, etc. into the oil system, even when a wire screen and filter is employed.

Such configurations may result in a variety of relief valve failures that may cause oil pressure problems. For example, when the relief valve is stuck in the closed position, pressure builds and may rupture the oil filter. When the relief valve is stuck in the open position, the resulting low oil pressure may cause bearing failure. If the relief valve is sticking, erratic pressure results. Therefore, there is a need in the art to vent off additional pressure without exposing the relief valve to debris that may result in relief valve failure. The present invention overcomes the deficiencies of the prior art by inverting the pressure relief valve and the valve seat to the high-pressure side. Therefore, as the valve opens the debris immediately "blows out" to the low-pressure side in a manner that prevents debris from wedging between the valve body and the valve seat.

Additional information will be set forth in the description that follows, which will be obvious in part from the description or may be learned by practice of the invention.

SUMMARY OF THE INVENTION

The valve assembly for relieving fluid pressure is provided. The valve assembly comprises a pump housing with a low pressure inlet chamber and a high pressure discharge chamber, a relief aperture positioned between the low pressure inlet chamber and the high pressure discharge chamber, a valve seat along the perimeter of the relief aperture, and a valve body located in the high pressure discharge chamber. The valve body has a first end capable of engaging the valve seat in a closed position, and is also capable of axial travel opposite the fluid discharge at a predetermined pressure.

DESCRIPTION OF THE DRAWINGS

Operation of the invention may be better understood by reference to the following detailed description taken in connection with the following illustrations, wherein.

DETAILED DESCRIPTION

While the present invention is described with reference to the embodiments described herein, it should be clear that the present invention should not be limited to such embodiments. Therefore, the description of the embodiments herein is illustrative of the present invention and should not limit the scope of the invention as claimed.

Figure 1A:
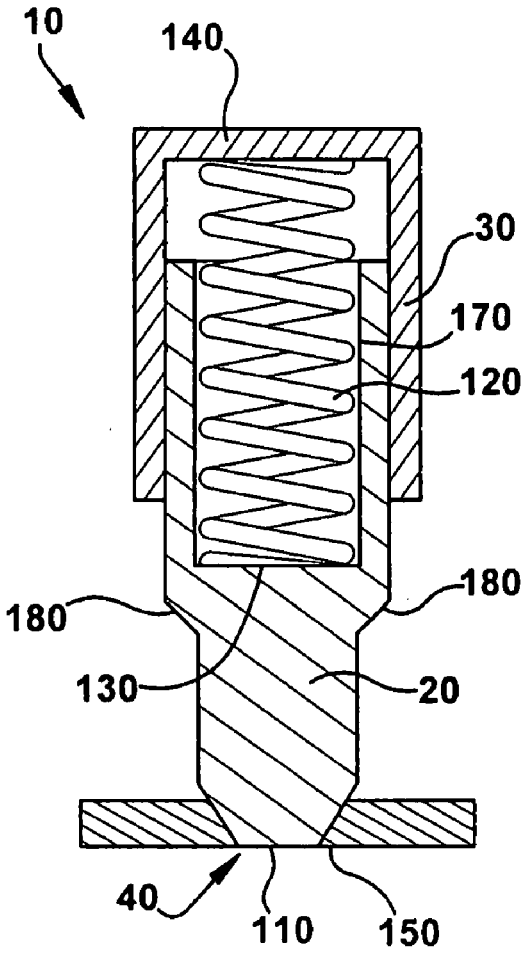
FIG. 1A is a sectional view of an embodiment of a valve assembly according to the present invention.
Figure 1B:
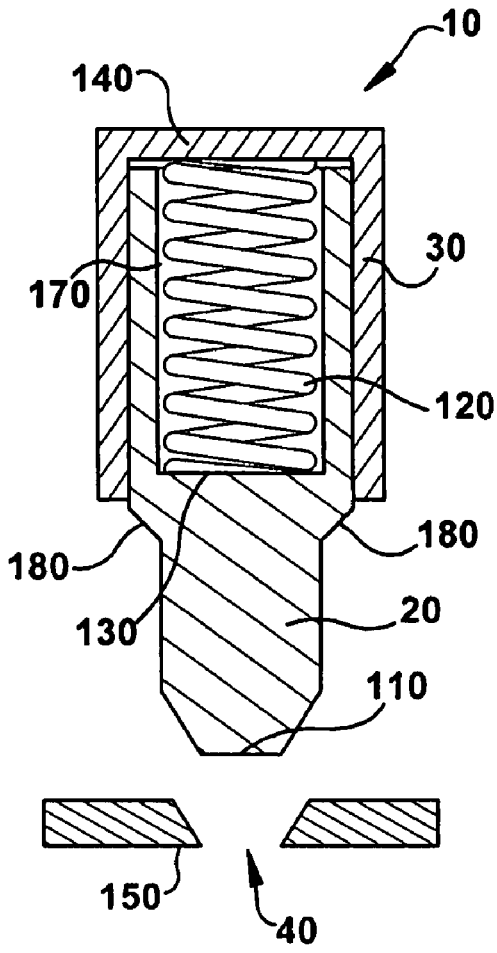
FIG. 1B is a sectional view of an embodiment of a valve assembly according to the present invention.
Figure 2:
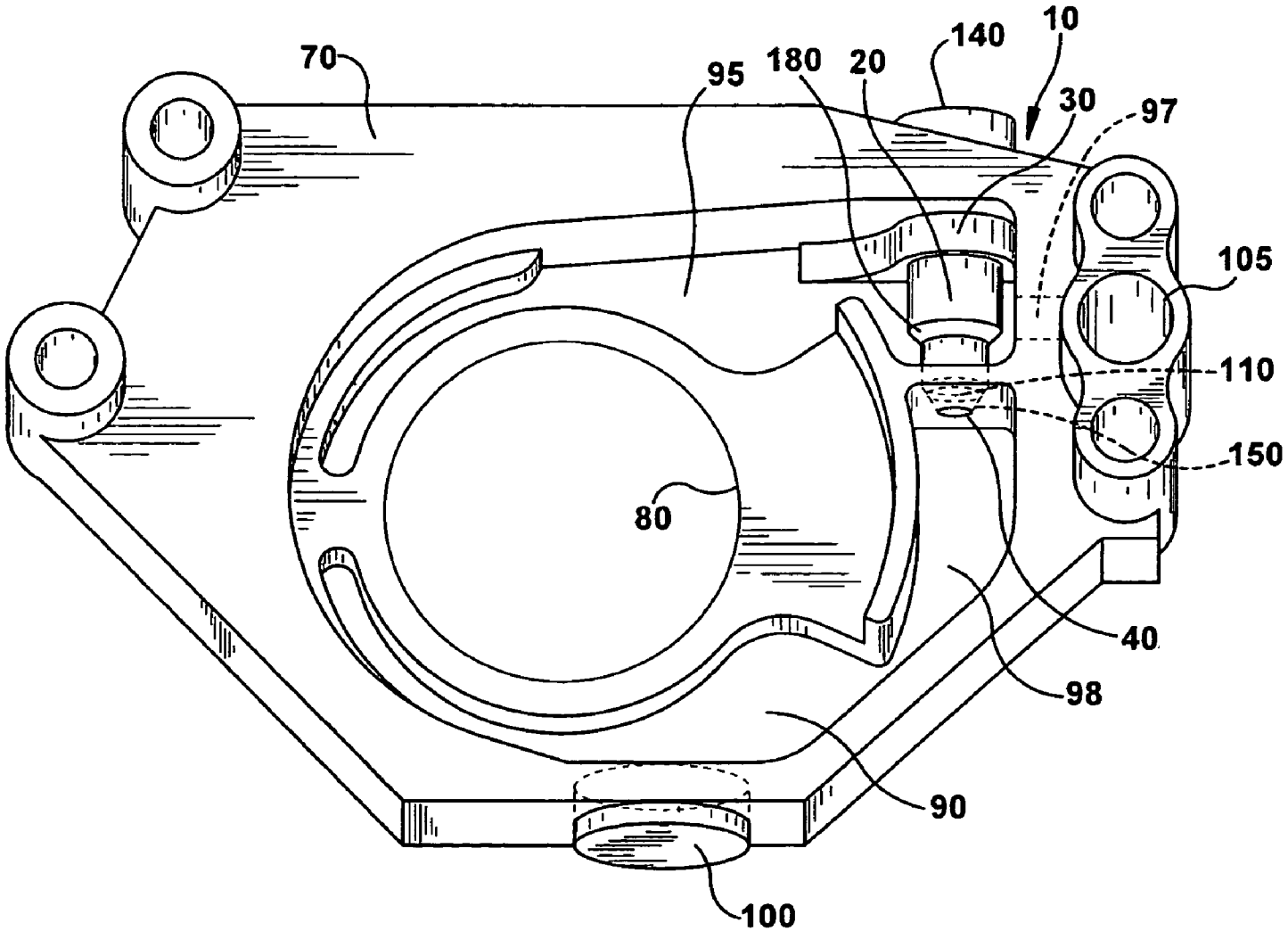
FIG. 2 is a perspective view of a pump housing of an oil pump provided with an embodiment of a valve assembly according to the present invention.

Reference will now be made in detail to the embodiments of the invention as illustrated in the accompanying figures. Embodiments of a pressure relief valve assembly 10 are shown in FIGS. 1 through 5. As shown in FIGS. 1A and 1B, the pressure relief valve assembly 10 generally has a relief valve 20, a valve housing 30, and a relief aperture 40. As shown in FIG. 2, the relief valve assembly 10 may be installed in an engine oil pump housing 70.

Figure 3:
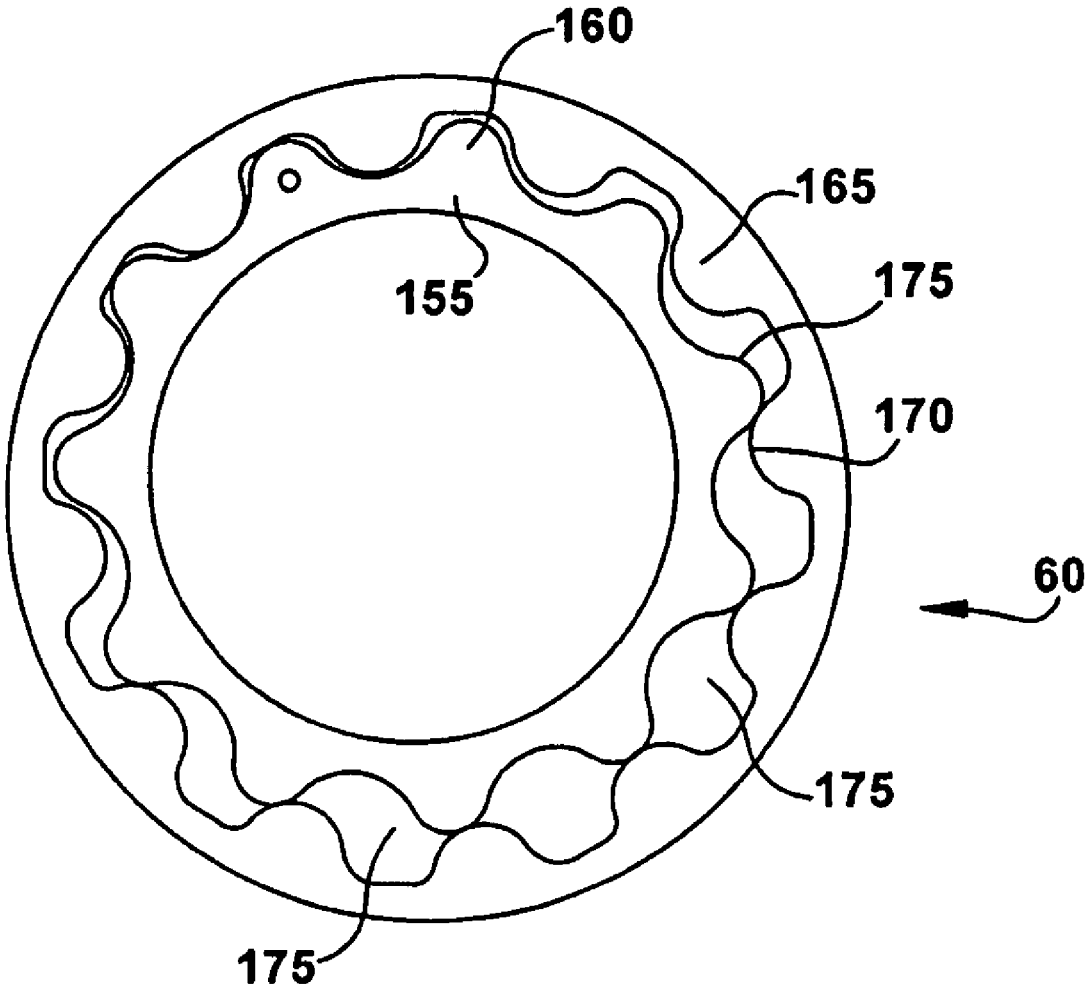
FIG. 3 is a perspective view of a gerotor pump.

The housing 70 is generally directly secured to an engine block or integrally mounted to an engine front cover. The housing 70 may be made from any suitable material, such as aluminum, and has a substantially circular cavity 80 for rotatably accommodating a pump. As shown in FIG. 3, the pump may be a gerotor pump 60 with an inner rotor 155 with external teeth 160 and an outer rotor 165 with internal teeth 170 whose number of teeth is larger by one than that of inner rotor 155. In the meshed state, the two rotors 155/165 cooperate with each other to define a plurality of fluid chambers 175. Inner rotor 155 may be coupled with an engine crankshaft (not shown) which acts as a driving shaft for inner rotor 155. Outer rotor 165 is driven by rotation of inner rotor 155 to circumferentially move fluid chambers 175 for variation in volume of each fluid chamber 175 to create a pumping action.

As best shown in FIG. 2, the housing 70 has a low-pressure suction chamber 90 and a higher-pressure discharge chamber 95. Fluid chambers 175 communicate with suction chamber 90, where the volume of each fluid chamber 175 increases, and discharge chamber 95 where the volume decreases. The suction chamber 90 and discharge chamber 95 may also be arranged in an inner wall of the cover (not shown) in the same way to correspond to those of the main body. Such an arrangement allows oil to enter suction chamber 90 via a suction port 100 and exit from discharge chamber 95 through a channel 97 and out a discharge port 105.

Referring to FIGS. 1A-B, a valve body 20 is slidingly disposed in the valve housing 30. Similar to the housing 70, the valve body 20 and valve housing 30 may be made from any suitable material, such as aluminum. The main function of the valve body 20 is to regulate oil pressure within the engine by keeping a substantially constant flow of oil to the engine. The valve body 20 is generally cylindrically shaped and has a front end 110 capable of engaging the valve seat 150 surrounding relief aperture 40. As shown, the front end 110 may be tapered to facilitate engagement with a valve seat 150 surrounding relief aperture 40. The valve body 20 is biased in the direction of the valve seat 150 by a pressure relief spring 120 disposed between inner wall 130 and valve housing end cap 140. It is understood that end cap 140 may be removable to allow replacement of the spring 120 and/or the valve body 20.

Figure 4:
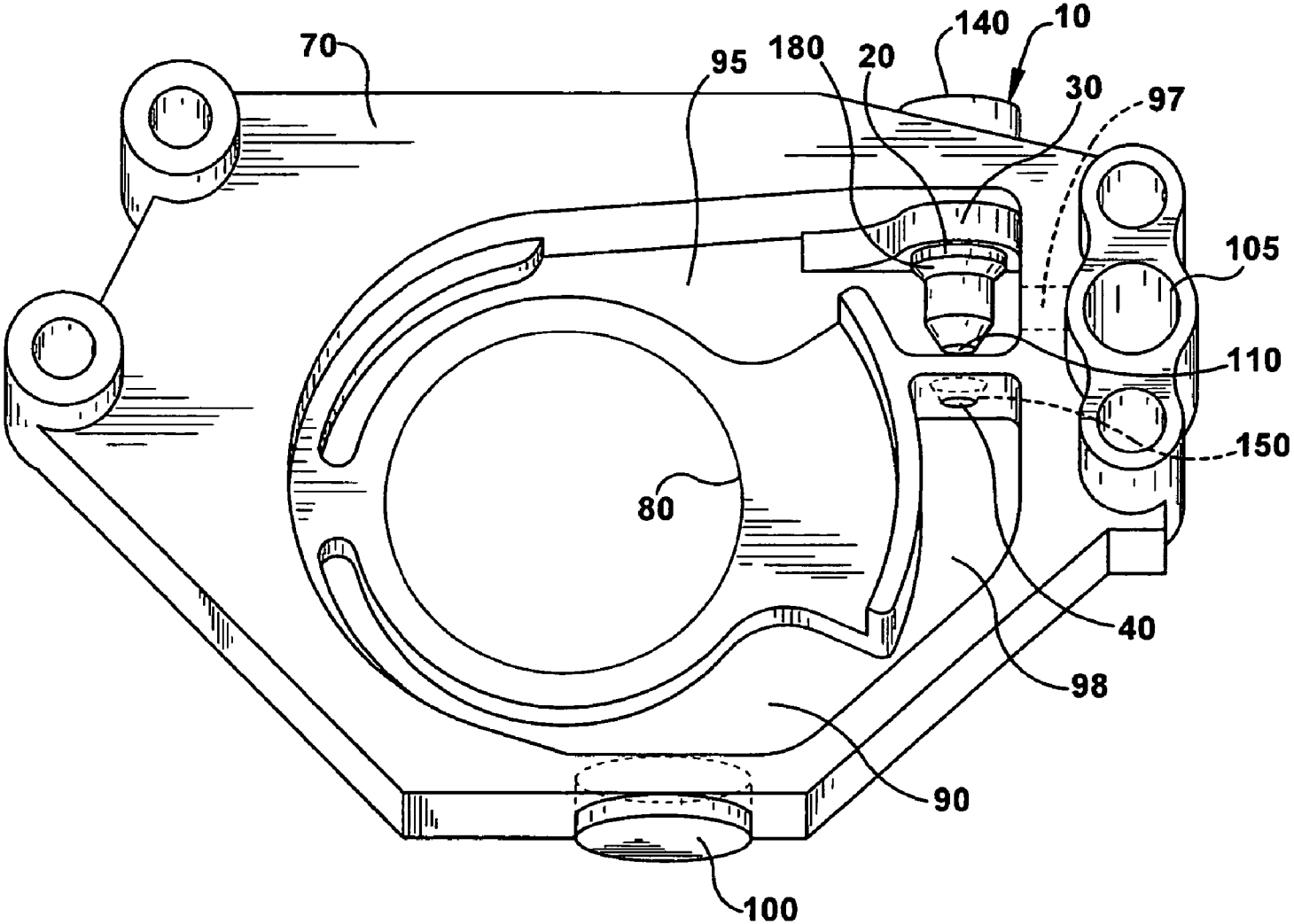
FIG. 4 is a perspective view similar to FIG. 2 showing another operational mode of the valve assembly.

Accordingly, when oil pressure throughout discharge chamber 95 is below a predetermined level, the front end 110 remains engaged with valve seat 150 so that relief aperture 40 remains closed. As shown in FIGS. 1B and 4, when the oil pressure reaches the predetermined level, the pressure exerted on the surface of the valve body 20, such as a shoulder 180, slides the valve body 20 toward end cap 140 away from relief aperture 40. This allows the oil to vent through relief aperture 40 and channel 98 to the low-pressure suction chamber 90.

Figure 5A:
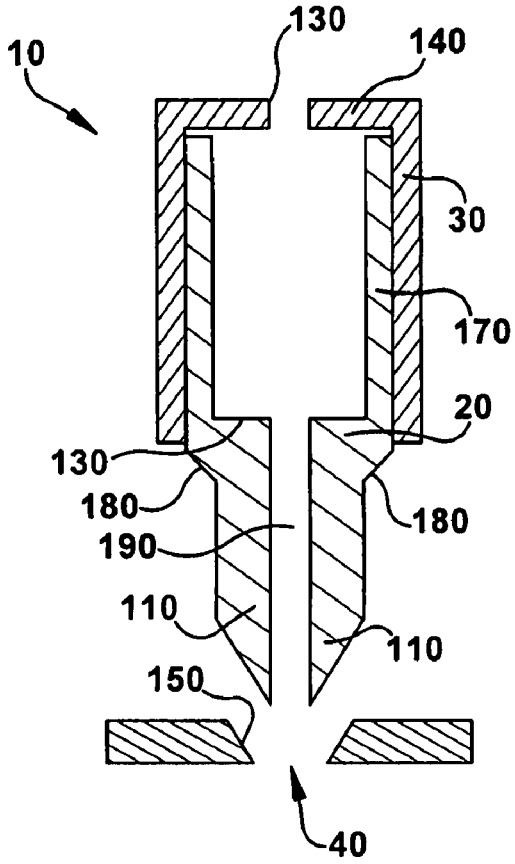
FIG. 5A is a sectional view of an embodiment of a valve assembly according to the present invention.
Figure 5B:
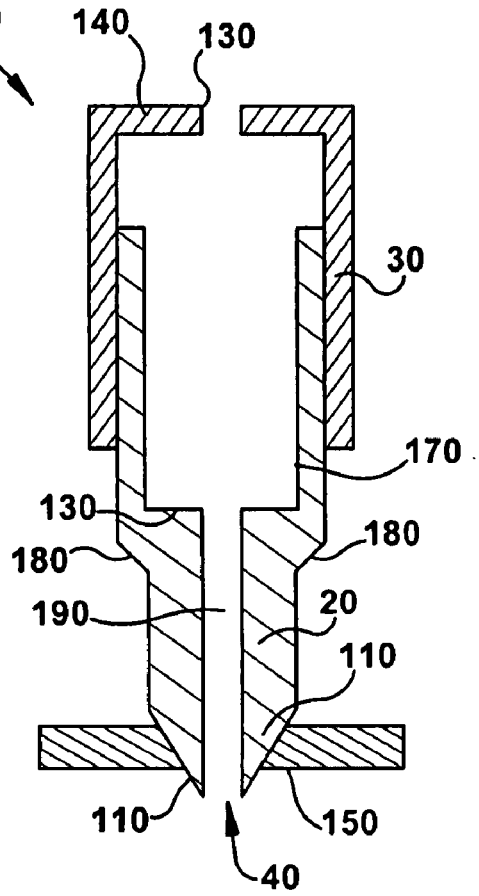
FIG. 5B is a sectional view of an embodiment of a valve assembly according to the present invention.

In some embodiments, as shown in FIGS. 5A and 5B (spring 120 not shown), spring chamber 170 may be internally vented by either an orifice 190 extending through the front end 110 and/or by an orifice 130 in end cap 140, if the oil pump design permits. This provides a low-pressure area in the spring chamber 170 that allows valve body 20 to move toward the end cap 140 when the external high pressure overcomes the opposing spring force.

Turning to the valve assembly 10, an example of how to use the valve assembly 10 as illustrated in FIGS. 1-5 is set forth below. As shown in FIG. 2, the valve body 20 is slidingly disposed in valve housing 30 and is capable moving toward and away from relief aperture 40 as the pressure changes. During normal pump operation, the biasing force of the spring 120 causes front end 110 to be engaged with valve seat 150, thereby closing relief aperture 40. As the gerotor pump 60 operates, oil is drawn through inlet 100 into suction chamber 90 and is pumped into discharge chamber 95. The oil flows around valve body 20 through channel 97, exiting via the outlet 105. During operation, debris may settle around the front end 110 and the relief aperture 40.

When a predetermined oil pressure has been achieved, the oil must be vented. To do so, as shown in FIGS. 1B and 4, the oil pressure exerted on shoulder 180 slides valve body 20 toward end cap 140 and away from relief aperture 40. Accordingly, the oil from the discharge chamber 95 is vented through relief aperture 40 and channel 98, connecting discharge chamber 95 to the low-pressure suction chamber 90. The assembly serves as a bypass to allow the oil to recirculate in the pump assembly from the high pressure discharge chamber 95 to the low pressure suction chamber 90, thereby preventing overpressure in the discharge chamber 95.

Unlike typical relief valve assemblies, the valve body 20 and valve seat 150 are located in the high-pressure discharge chamber 95. In addition, the valve body 20 moves counter to the direction of the oil flow when relieving pressure. By inverting the valve body 20 and providing a surface area (shoulder 180) for the pressure to act on the valve body 20, there is no cavity or depression for debris to collect in on the high-pressure discharge side. If any debris does accumulate near the valve seat 150, it will "blow free" and away from the valve body 20 and valve housing 30 when the valve body 20 slides toward end cap 140. Therefore, unlike the prior art configurations, the valve body 20 and valve housing 30 are not exposed to the fluid flow that could wedge debris therebetween. In addition, the assembly 10 eliminates the bottleneck of the prior art, in which the debris could easily lodge between the valve body and the valve seat. Therefore, any debris present is quickly removed away from the valve body 20, valve housing 30, and valve seat 150, resulting in fewer failures and increased operational reliability.

In addition, as shown in FIGS. 5A and 5B, low pressure in the spring chamber 170 can be achieved by venting the otherwise trapped volume to the low pressure suction chamber

90 via orifice 190. Venting may also be achieved by simply venting end cap 140 via orifice 130 to the environment of the oil crankcase, if the design allows. This allows a low-pressure area in the location of the spring, which further allows the valve body 20 to move toward the end cap 140 when the external high pressure overcomes the opposing spring force. If the spring chamber 170 were not vented to low pressure at that point, it might become hydraulically locked, and thus inoperative.

The invention has been described above and, obviously, modifications and alternations will occur to others upon the reading and understanding of this specification. The claims as follows are intended to include all modifications and alterations insofar, as they come within the scope of the claims or the equivalent thereof.

We claim:

1. A valve assembly for relieving fluid pressure, comprising:

a pump housing having a pump chamber, a low pressure inlet chamber, and a high pressure discharge chamber;

a relief aperture positioned between said low pressure inlet chamber and said high pressure discharge chamber for fluid communication therebetween;

a valve seat along the perimeter of said relief aperture facing said high pressure discharge chamber;

a valve body located entirely in said high pressure discharge chamber, said valve body having a length coaxially aligned with said relief aperture and a first end capable of engaging said valve seat, wherein said valve body is capable of axial travel at a predetermined pressure between a first position wherein said first end is engaged with said valve seat and a second position wherein said first end is positioned a distance away from said valve seat;

wherein said valve body has an orifice at said first end to internally vent said valve body to said low pressure inlet chamber; and wherein a first rotor and a second rotor are disposed in said pump chamber for pumping oil from said inlet chamber to said discharge chamber.

2. The valve assembly of claim 1 wherein said first end is capable of engaging said valve seat so that substantially no debris can collect around said valve seat.

3. The valve assembly of claim 2 wherein said first end is tapered.

4. A valve assembly for relieving fluid pressure, comprising:

a pump housing having a pump chamber, a low pressure inlet chamber, and a high pressure discharge chamber;

a relief aperture positioned between said low pressure inlet chamber and said high pressure discharge chamber for fluid communication therebetween;

a valve seat along the perimeter of said relief aperture facing said high pressure discharge chamber;

a valve body located entirely in said high pressure discharge chamber, said valve body having a first end and an orifice at said first end to internally vent said valve body to said low pressure inlet chamber;

a biasing member directing said valve body toward said valve seat so that said first end engages said valve seat in a closed position, and wherein when the pressure in said high pressure discharge chamber reaches a predetermined level, the pressure acts on said valve body to move said valve body a distance away from said valve seat; and wherein a first rotor and a second rotor are disposed in said pump chamber for pumping oil from said low pressure inlet chamber to said high pressure discharge chamber.

5. The valve assembly of claim 4 wherein said biasing member is a compression spring.

6. The valve assembly of claim 5 wherein said first end is capable of engaging said valve seat so that substantially no debris can collect around said valve seat.

7. The valve assembly of claim 6 wherein the diameter of said valve body increases along the length of said valve body from said first end.

8. The valve assembly of claim 7 wherein said first end is tapered.

9. The valve assembly of claim 4 wherein said valve body is metal.

10. The valve assembly of claim 9 wherein said valve body is aluminum.

* * * * *